United States Patent [19]

Nilsen et al.

[11] Patent Number: 4,875,354

[45] Date of Patent: Oct. 24, 1989

[54] MACHINE FOR ADJUSTABLE LONGITUDINAL CORRUGATING OF SHEET MATERIALS

[76] Inventors: Trond Nilsen, Engerjordet 19, 1310 Bloommenholm; Erling C. Normann, Bjorketun 6, 7650 Verdal, both of Norway

[21] Appl. No.: 104,011

[22] PCT Filed: Jan. 16, 1987

[86] PCT No.: PCT/NO87/00007

§ 371 Date: Oct. 13, 1987

§ 102(e) Date: Oct. 13, 1987

[87] PCT Pub. No.: WO87/04375

PCT Pub. Date: Jul. 30, 1987

[30] Foreign Application Priority Data

Jan. 17, 1986 [NO] Norway ..... 860156

[51] Int. Cl.[4] ..... B21D 13/04

[52] U.S. Cl. ..... 72/180; 72/178

[58] Field of Search ..... 72/179–182, 72/176, 234, 226, 183, 178

[56] References Cited

U.S. PATENT DOCUMENTS

| | | | |
|---|---|---|---|
| 819,644 | 5/1906 | Flatau | 72/181 |
| 1,673,787 | 6/1928 | Frahm et al. | 72/181 |
| 1,770,963 | 7/1930 | Yoder | 72/181 |
| 2,163,063 | 6/1939 | Romanoff | 72/177 |
| 2,176,115 | 10/1939 | Yoder | 72/181 |
| 3,823,592 | 7/1974 | Colbath | 72/181 |
| 4,269,055 | 5/1981 | Sivachenko et al. | 72/180 |
| 4,549,422 | 10/1985 | Harrow | 72/183 |

FOREIGN PATENT DOCUMENTS

| | | | |
|---|---|---|---|
| 747729 | 10/1944 | Fed. Rep. of Germany | 72/182 |
| 823629 | 1/1938 | France . | |
| 2436634 | 9/1978 | France . | |
| 2539339 | 1/1983 | France . | |
| 22569 | 6/1971 | Japan | 72/180 |
| 37833 | 9/1972 | Japan | 72/181 |
| 100826 | 8/1980 | Japan | 72/181 |
| 72744 | 5/1982 | Japan | 72/181 |
| 183936 | 10/1983 | Japan . | |
| 221131 | 11/1985 | Japan | 72/181 |
| 651872 | 3/1979 | U.S.S.R. | 72/181 |
| 717650 | 10/1954 | United Kingdom | 72/182 |
| 1211835 | 11/1970 | United Kingdom . | |
| 2141854 | 1/1985 | United Kingdom . | |

*Primary Examiner*—Daniel C. Crane

*Attorney, Agent, or Firm*—James E. Pittenger

[57] ABSTRACT

A machine for adjustable longitudinal corrugating of sheet materials, particularly of metal with stepwise folding/bending over free-running rollers and counter-rollers, so that alternating longitudinal convex and concave corrugations are formed. At each profiling step there are upward and downward forming rollers (47) which can be individually adjusted laterally to the direction of corrugation. Separate from the forming rollers there are at least one set of drive rollers (60) and counter-rollers (37) where both the drive rollers and the counter-rollers can be adjusted laterally to the direction of corrugation.

10 Claims, 4 Drawing Sheets

MACHINE FOR ADJUSTABLE LONGITUDINAL CORRUGATING OF SHEET MATERIALS

Figure 1:
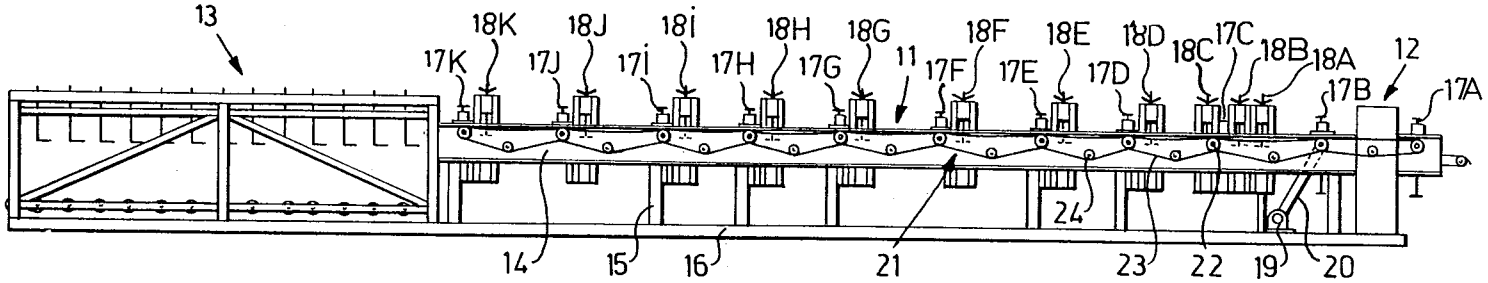

The invention refers to a machine which is designed for longitudinal corrugating of metal sheeting, in continuous strips or separate sheets for building purposes or similar applications.

Existing machines are known where each forming step has an integrated, specially designed upper and lower roll forming set for combined stepwise forming and propulsion of the sheet material. Each roller is designed with alternating ridges and grooves which correspond to the convex and concave profiles in the sheet material passing through the rollers. Such roll-forming machines are expensive and reguire highly-skilled operators, these machines are also costly and complicated to run as well as maintain, particularly because they require numerous extremely costly roller sets, and a relatively long profiling stretch. Moreover, each profile shape requires a complete set of individually designed forming rollers. Thus any change from one type of profile to another involves the replacement of every set of forming rollers with new ones, meaning that there will be a long changeover time. Furthermore, the roller housing brackets and the drive arrangement have to be specially designed for this purpose which further increases production costs and complicates this type of corrugating machine.

In addition, these forming rollers have limited applications regarding the material characteristics thickness and the type of coating. The sheet material which can be used stipulate certain specific rigid requirements which have to be observed when the forming rollers are adjusted, depending on the material's character and the thickness of the sheet This means that existing roll-forming mills are limited both in the choice of material and the profile and corrugation patterns. An alternative has been to base production on a relatively high output of each profile, consequently the variety in sheet thickness and sheet qualities are extremely limited.

A Swedish Patent, No. 348, 955 concerns a corrugating machine where each forming step consists of an upper and lower axle arranged in pairs, where at least one of the axles is a drive shaft. Propulsion and corrugating of the sheet is facilitated by means of paired counter-acting rollers. One of the rollers in such a pair is free-running or is connected to a free-running axle. Furthermore, one of the rollers in each pair has a larger diameter than the other, the two rollers being located alternatively on the upper and lower axle. When a sheet is squeezed by the rollers, this will result in the concave profiles, only the flanges or chamfered parts of the sheet are allowed to run freely during the corrugating process. Each pair of rollers has fixed cross-sectional positions. This design places exacting demands upon the diameter of the rollers, and this corrugating machine has no possibilities for adjustment apart from finer adjustments to the thickness of the material. This configuration is consequently very inflexible as it requires the installation of complete sets of new rollers each time the corrugation pattern is changed. There are also a number of other disadvantages with this kind of corrugating machine.

French, Patent No. 867,039 describes a corrugating machine with a number of profiling steps for combined propulsion and preshaping of a sheet into waves. This is done to arrange the sheet materiale and the material distribution before final finishing by a conventional roll forming machine into a trapezoidal or a similar shape. In this machine the individual forming rollers are mounted separately on juxtaposed pairs of axles. The forming rollers have rounded wheel paths to ensure that there is sufficient contact with the sheets to push them forwards. It is assumed that the rollers act independently without any counter-acting rollers. These rollers are designed so that there is no possibility of forming sharp profiles.

The main purpose of the present invention is to make a simple, reliable machine to corrugate metal sheets. Folding or corrugating should be facilitated by a fixed setting for the sheet thicknesses in normal use. It should also be possible to reduce the roller resistance and energy consumption. The machine must be quick and simple to reset from one profiling pattern to another. Furthermore, the machine should provide a large choice in the profile patterns available. The machine should be preferably constructed from uniform, standard, lightweight components. One particular concept is designing the machine so that it can be reset by an operator single-handedly without the use of lifting equipment or other special tools. This would make it possible to manufacture special profiles in small quantities.

A final element is that the machine should cost less to build than existing corrugating machines.

Various aspects of the invention, its functions and advantages are evident from the specified examples below and the functional description given.

Figure 2:
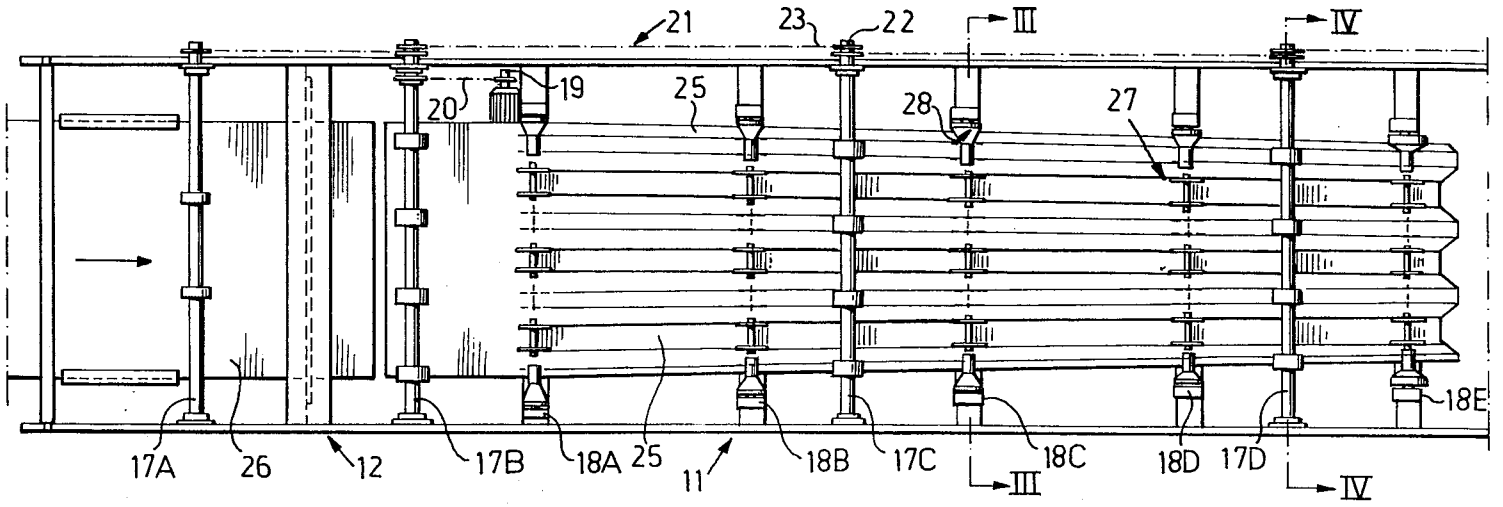
Figure 3:
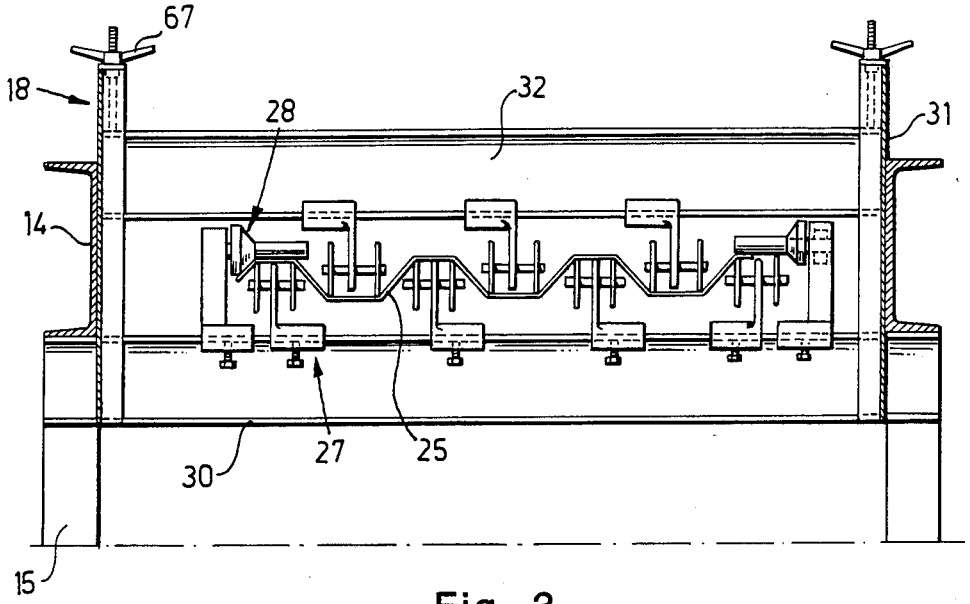
Figure 4:
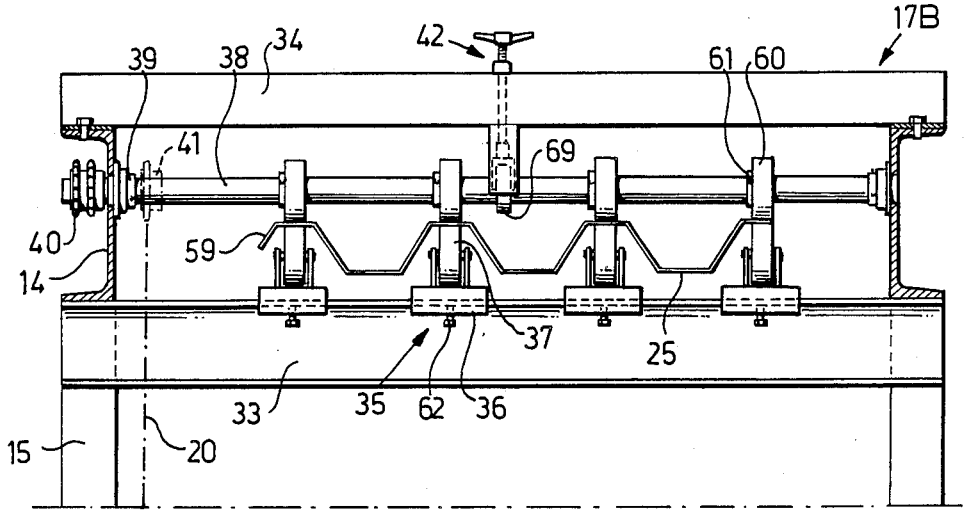
Figure 5A:
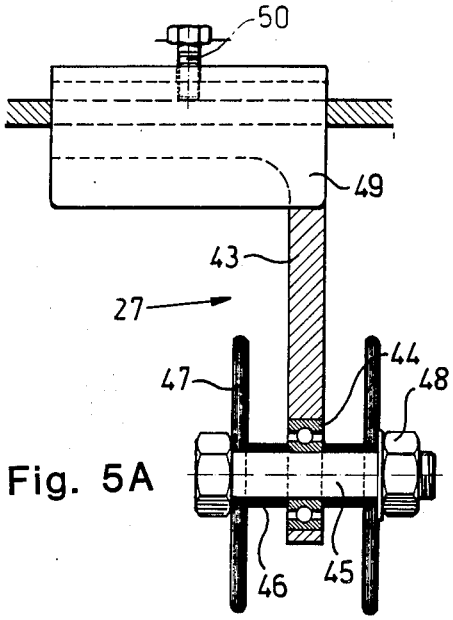
Figure 5B:
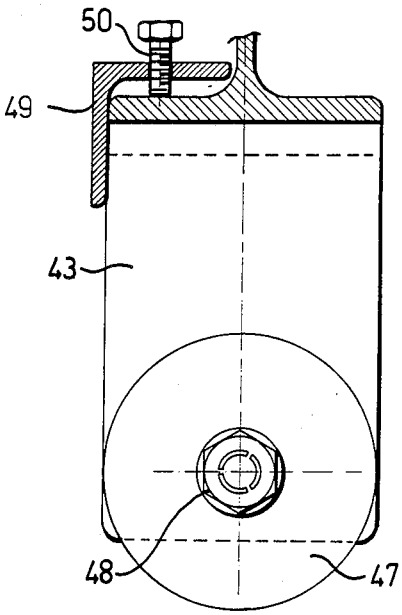
Figure 6:
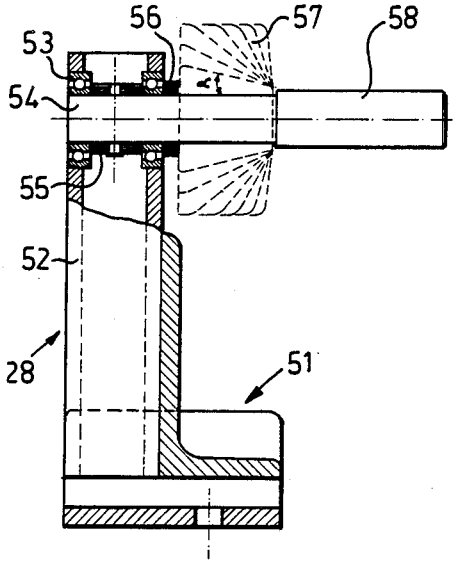
Figure 7:
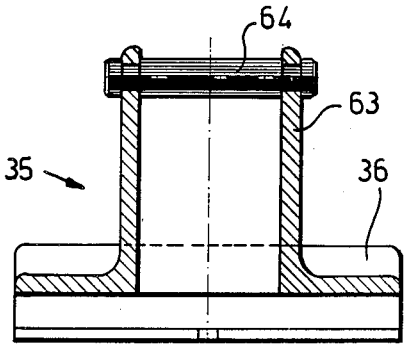
Figure 8:
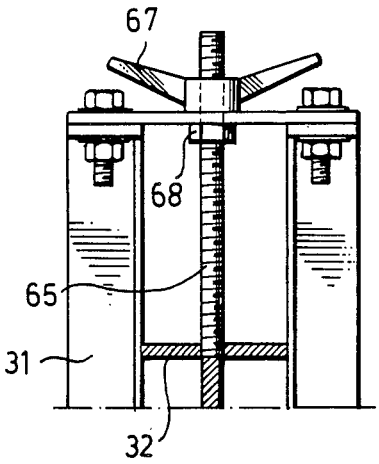
Figure 9:
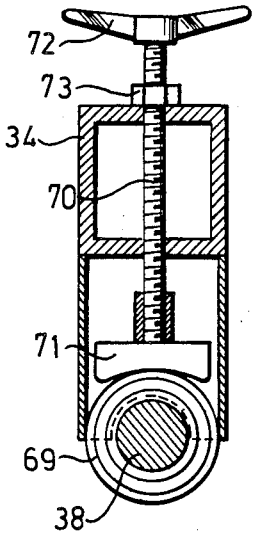

FIG. 1 shows a schematic cross-section of a machine designed in accordance with the invention, FIG. 2 shows an overhead schematic plan of the feed end of the machine in FIG. 1, FIG. 3 shows a schematic vertical cross-section along line II—II in FIG. 2, FIG. 4 shows a schematic vertical corss-section along line III—III in FIG. 2, FIG. 5A shows a detail cross-section of a roll-forming unit, FIG. 5B shows a cross-section of the roll-forming unit in FIG. 5A with a detail of the support and roller housing bracket, FIG. 6 shows a detail cross-section of a roller unit for edging, FIG. 7 shows a detail cross-section of a counter-roller housing, FIG. 8 shows a vertical cross-section through a mechanism for regulating the height of the support beam in FIG. 5B, and FIG. 9 shows a vertical cross-section through a device for regulating the rolling pressure.

The machine which is illustrated in FIG. 1 comprises a main unit 11 where the corrugating is done, and guillotine 12 located at the feed end and receiving table 13 at the outlet.

An existing cutting mechanism can be used for the guillotine 12. This is located in the material pathway. It can be designed so that the same guillotine can be used for all types of material for corrugation.

The receiving table 13 can be designed in several appropriate ways that incorporate a clamp and a pathway which is accessible for the removal of piles sheets.

The main unit 11 consists of two parallel longiutdinal sidewalls 14 (see FIG. 3), which are supported by vertical supports 15 attached to the base frame 16.

The main unit 11 also incorporates eleven drive units 17 A–K. The first drive unit 17A is located at the inlet end, in front of the guillotine 12. The main unit 11 also incorporates eleven roll-forming units 18A–K. The first roller unit is located after the first two drive units 17A–B. Roll-forming units 18A–B and 18C–D are located in pairs with drive unit 17C between them. The other roll-forming units are located in pairs along the sidewalls 14 with drive units between in the order indicated.

The detailed design of the roller units and the drive units will become evident from the description below. The drive motor 19 shown in FIG. 1, drives a chain 20 which in turn drives the drive chain unit 21 which is connected to a drive wheel 22 on each of the drive units 17A–B. The drive chain unit consists of a chain 23 linking the drive units in pairs and tension wheel 24.

When introducing sheeting at the feed end it is advantageous if there is a gap between two consecutive sheets, consequently it would be useful if the first drive unit ran a little slower than the subsequent ones. This can be done by using drive rollers with a slightly smaller diameter than the drive rollers further in the machine.

A holder for rolls of sheeting (not shown) is located at the feed end.

FIG. 2 illustrates the feed end of the main unit 11 with the quillotine 12. Here a piece of sheeting 25 is shown passing through the machine and a second sheet 26 being fed in after the first.

FIG. 2 provides a schematic representation where the upper parts of the roll-forming units and the drive units have been removed, which shows the drive roller units 27, and the edge roller units 28, both in the roll-forming units and the drive rollers 29 in the drive units. A more detailed description of these components will be given below.

FIG. 3 shows a vertical cross-secction through the main unit 11, depicting a front section of a roll-forming unit 18 during the corrugation of a sheet 25.

Each roll-forming unit 18 consists of a lower support beam 30 which is attached to the sidewalls and which supports a lower set of drive roller units 27. A sliding upper support beam 32 is located on the inner sides of two parallel posts 31 extending upwards from their respective sidewalls 14. This support beam 32 can be adjusted both up and down in a manner described in detail below. The beam 32 supports an upper set of roller units 27. At each side there is an edge roller unit 28. These roller units will be described in more detail below.

FIG. 4 shows a vertical cross-section through the main unit, depicting a front section of a drive unit 17. The drive unit 17 has a lower beam 33 similar to the lower support beam 30 in FIG. 3 and a fixed upper beam 34 which has bolts connecting it to the upper edge of the sidewalls 14. The purpose of the upper beam 34 is explained below.

Four counter-roller units 35 are attached to the lower beam 33, each of these has a housing bracket 36 which is to be bolted onto the upper flange of the lower beam 33, and a counter-roller 37. A more detailed description of the counter-roller units is given below.

A drive shaft 38 is located between the two sidewalls 14 by means of a suitable bearing 39. Apart from the double chain wheel 40 on the drive end of the shaft, there is also chain wheel 41 on drive unit 17B which is connected to the drive chain from the motor.

In the middle of the upper beam 34 there is a support unit 42 which will be described in more detail below.

FIGS. 5A-B shows a roller unit 27 which is designed for corrugating billets or sheeting. Each roller unit consists of an L-shaped roller housing bracket 43 with an arm which is designed for attachment onto the lower edge of the upper support beam 32, on the upper edge of the lower support beam 30 (see FIG. 3). On the other arm of the roller attachment there is an orifice for ball bearings 44 and an axle 45 shaped like a nut and a bolt. On each side of the bearings 44 inner ring, there is a spacing bush 46 which is located between the two forming rollers 47. The forming roller 47 and the spacing bushes 46 are pressed against the ball bearings 44 by one of the nuts 48 on the axle 45. This enables the forming rollers 47 to rotate freely with the axle 45.

The forming rollers 47 are designed in a sheet material with a thickness as in the example, of about a twentieth of the diameter. The rollers must have rounded edges. The tounding on the rollers helps determine the sharpness of the folds formed on the sheeting 25 (FIG. 3). The roller units 27 will have wider applications if the forming rollers 47 are evenly rounded. The bracket 49 is shaped as an angle iron with one arm attached to the side of the roller housing bracket 43 and the other arm parallel to the roller axle, located towards the central plane of the roller unit so that there is a gap between it and the arm of the roller housing bracket 43 which points towards the support beam.

The free end of the bracket 49 is prethreaded for a bolt 50 for attachment purposes (see FIG. 5B).

Other roller units could be considered for the formation of grooves for example. Here free-running forming rollers could be used which are located in opposition to counter-rollers in the manner described above. It would be advantageous if such units were designed to be as similar to the other roller units as possible.

FIG. 6 shows an example of an edge roller unit 28. This is mounted on a base 51 which is similar to the bracket 49 with the drive roller unit 27. From the base 51 there is a support post protruding upwards, this could be a square tube. On the protruding free end of the support post 52, two ball bearings 53 are located in each of the sides to support a spindle 54 with a lock bushing 55 inserted between the ball bearings. On the inner part of the spindle 54, possibly using an intermediate ball bearing 56 there is a cone roller 57 for shaping chamfered edges. A cylindrical spindle pin 58 protrudes from the cone roller 57.

The edge roller unit 28 will be located next to an upper or lower roller unit 27 (see FIG. 3) so that two of the forming rollers 47 press the sheeting towards the spindle pin 58 to ensure that a chamfered flange is made by the cone rollers 57 at the edge of the sheeting.

If rollers are used with different pitch angles and the edge roller unit 28 is adjusted laterally, different chamfered flanges 59 can be manufactured (see FIG. 3).

An example of a drive unit 17B is given in FIG. 4. The drive shaft 38 drives four drive rollers 60 which are located and hindered from rotating and axial displacement by means of locking nuts 61. These drive rollers can easily be moved along the drive shaft 38 to adjust the machine to other profiling patterns.

FIG. 7 provides a detail illustrating the counter-roller units 35 in FIG. 4. Each roller unit has a base or housing bracket 36 which is similar to bracket 49 in FIG. 5A. The counter-roller units 35 can be attached to the upper edge of the lower beam 33 by means of bolts 62.

The parallel supporting arms 63 protrude upwards from the locating bracket 36 with a roller shaft 64 between them which is located in an appropriate manner by a forked aperture at the top of each support arm. The shaft 64 drives a counter-roller 37 (not shown) (see FIG. 4).

The dirve rollers 60 and the counter-rollers 37 should preferably have elastic roller paths to increase friction with the sheeting and provide greater variation in sheeting thickness without requiring adjustment. Optimal results will be obtained when the drive rollers and counter-rollers are identical in diameter and width, and have the same path material.

FIG. 8 shows a section of a regulation unit for the upper support beam 32 in FIG. 3. The twin posts 31 form a groove for the upper suppot beam 32 to move in. The upper support beam 32 is held in place by a threated bolt 65 which is led through a connecting plate 66 at the top of the twin support posts 31. The threaded bolt can be screwed up and down by the adjustment nuts 67 above the connecting plate 66 and a locking nut 68 below it.

FIG. 9 shows a detail of the support unit 42. The drive shaft 38 has a bearing 69 attached. Above this is a threaded bolt 70 with a pressure lug 71. The threaded bolt 70 is inserted through the upper beam 34. The bolt 70 has a handle 72 and a locking nut 73. This mechanism provides support for the drive shaft 38 and prevents it bending, allowing it to be designed with a small diameter. Furthermore, the clamp pressure can be adjusted to the quality of the material.

The functioning of the machine will now be described referring to existing corrugating machines.

The invention can be freely regulated with regard to profile heights, widths, profile shape, the number of corrugations, the shape of edges etc., using simple, standard equipment. The invention can also be used to form various types of profiles and profile heights, even profiles with different corrugation heights in the same profile pattern. This being achieved by moving the forming rollers laterally or exchanging them with laterally pre-adjusted forming rollers units, there will be an additional simple height adjustment of the upper and/or lower roller units depending on the mode of construction. Both parts relate to a fixed basis or adjustment measure which has been calculated for that particular profile pattern.

It will also be possible to make minor adjustments to profile heights as well as the module widths of the main corrugations, and if necessary, the width of the corrugations can also be adjusted. Thus any particular profile with a suitable number of corrugations can be adapted to an arbitrary width of available sheet material.

None of these features are possible with existing thin sheet corrugation machines, which necessitate the use of a complete set of special designed forming rollers for each new profile.

Furthermore, the machine corresponding with the invention has a fixed setting for an individual profile, regardless of the thickness and qualiity of the sheet material. With existing corrugating machines, relatively small changes in the thickness and quality of the sheet material require pain-staking and time-consuming re-adjustments of every pair of forming rollers.

A preferable mode of construction would be one where the profiling rollers had identical shapes and dimensions, e.g. with roller diameters of only between 60–120 mm, and widths of only between 5–25 mm regardless of profile size and height of corrugations. The same criteria apply to optionally movable special units for various means of shaping the profile edges, which in the preferred mode of construction are all identical except for varying the pitch angles of the cone rollers 57 for shaping chamfered edges.

Moving parts in direct contact with the sheet have the same velocity in the moving direction of the sheet at points of contact as the real moving velocity of the sheet. Furthermore, they have negligble material mass and rolling resistance compared to corresponding moving parts in existing known roll-forming machines. This results is a very simple and inexpensive type of drive arrangement for the machine, as well low motor power requirements. With ordinary sheet thicknesses of up to 1.2 mm and normal sheet material quality in steel or aluminium, disregarding that profile type and height of corrugations, it will be sufficient to have a drive shaft diameter of 50 mm and a duplex ¾" drive chain or the equivalent for the drive connection between the motor and the main drive-shaft. The diameter of the secondary drive-shafts of double or single type will be resp. 30 or 50 mm with either a single or duplex ¾" drive chain inter-connection.

Moreover, it is sufficient with a motor power of about 3 kW even at the highest practical profiling speed (approx. 20 m/min) regardless of the size and type of profile. The device for slow start and slow stop is superfluous.

All of this is different from any known roll-forming machines which operate with a large number of moving parts, requiring considerable motor power as well as complicated accessories both for the slow start and slow stop. Furthermore, the forming rollers have points of contact with the sheet where the drive velocities deviate slightly from the velocity of the sheet. This is because the shape of the forming rollers conform with the profile which implies a varying distance from the axis of rotation to the points of roller surface contact with the sheet, thus the squeezing action during the roll-forming of the corrrugation subjects the sheet to uneven tensions and problematic stresses. In order to get around these problems, this structurally necessitates a large number of forming steps, very long profiling stretches as well as large roller dimensions. In addition, known roll-forming machines require thorough re-adjustment both when changing sheet thickness and sheet quality. When there is a critical sheet thickness and/or sheet quality it is not unusual that a lubricant has to be applied to the sheet in order to avoid disfiguring stresses in the finished profile, or even worse that it is impossible to complete the profile work. Likewise, when using known roll-forming machines certain discrepancies in the covering width of the finished profile are unavoidable as the contraction during the corrugating varies, because of both the thickness and quality of the sheet.

Another problem with known profiling machines is that it is impossible to form all-in-one corrugations from the start. The corrugating has to start in the middle of the profile, with successive corrugations progressing outward towards the sides after finishing adjacent corrugations on the inside. Otherwise, the profiling would trail off or get jammed after a few roll-forming steps.

With the invention there is no similar squeeze action to cause a sidewise blocking of the sheet during corrugating with the associated problems, nor is there any velocity deviations between the sheet and the contact points of the moving parts. Since there is no roller resistance worth mentioning, there will not be any critical stresses or uneven tension, providing the rollers are correctly positioned according to the pre-determined adjustment measures for the particular profile pattern.

The same covering width will always be obtained regardless of the thickness and quality of the sheet, as neither the thickness nor the quality of the sheet will influence the contraction of the sheet to any significant extent. Furthermore, there is nothing to obstruct corrugating in full width from the first forming step onwards. The invention makes it possible to complete the corrugating of the sheet material using fewer forming steps, and thereby substantially shorter profiling stretches than that of other known corrugating machines, and this ensures both more reliable and better results.

With the machine according to the present invention, the sheet may be cut to length since the guillotine is positioned before the section where the corrugating is done. This means that there is no significant flare as the near end of the sheet passes one profiling unit and runs freely on to the next. Consequently, it is also possible to corrugate pre-cut pieces of sheet.

By using feed-rollers with elastic rollers having a smaller drive diameter (o.D) than that of the other drive rollers a gap is always obtained in between successive sheets, as it is caught by the main drive roller. The subsequent sheet has slightly less velocity than the sheet running in front. This occurs without any significant resistance when the main drive rollers take over the lead, as the elastic feed-rollers easily yield and slip since the rollers have very modest roller pressure. This gap between the sheets may be utilized in connection with a simple switch to guide the sheets on to a receiving table without stopping the corrugating process, and without risking that the sheet coming from behind will cause problems.

Other known corrugating machines of ordinary length require sheets to be cut after the profiling is finished. This is due to the flare as the rear end of a sheet leaves a forming step, which unavoidably causes problems in the following forming steps. Consequently, the guillotine cutting blades have to be shaped exactly like the shape of the finished profile, meaning a special set of guillotine cutting blades for each and every profile.

The machine described in the examples can vary in a number of ways within the framework of the invention. On a simple machine, the forming rollers could e.g. be located on a common upper and an equivalent common lower shaft. If the forming rollers were moved laterally, different corrugation patterns can be produced. Similarly, a configuration could include a drive shaft under the sheet pathway, this will allow two-sided operations.

Modifications can also be made to the details. The forming rollers could be located on a free-running shaft.

An alternative design would mean that from a certain profiling step only the edge roller units would be held in a lateral direction and the remainder could be axially free-running on slide bearings, which could e.g. be connected to the shaft.

We claim:

1. A machine for adjustable longitudinal corrugating of sheet materials, particularly of metal, with stepwise bending over free-running rollers and counter-rollers, so that alternating longitudinal convex and concave corrugations are formed with the convex corrugations establishing ridges and the concave corrugations establishing grooves, characterized in that (1) at each profiling step there are sets of upward and downward free-running forming rollers, these forming rollers have means to be individually adjusted to vary the distance between the corrugations, (2) at least one set of drive rollers are located with corresponding counter-rollers between an upstream and downstream profiling step, said drive rollers in each set are mounted on a common drive shaft and the counter-rollers are mounted on a free-wheeling shaft with the drive rollers and counter rollers arranged to only feed said corrugated sheet material, said forming roller sets and said drive roller sets are arranged alternately along said machine, the drive rollers and counter-rollers can be adjusted laterally to vary the distance between the corrugations, (3) all forming rollers which correspond to a ridge or groove lie in the same plane, points of contact between the sheet material and the forming rollers that form grooves, or ridges respectively, lie in a curved plane, the points of contact between the drive rollers and the sheet material lie in a common horizontal plane, and (4) the forming rollers are arranged in pairs with a common free-running shaft, the forming rollers are equipped with an attachment means which permits location in any selected lateral position on a transverse beam which is part of each profiling step.

2. A machine in accordance with claim 1, characterized by that at one or more of the profiling steps there is side edging means and each side edge means includes an edge forming unit and a counter rolling unit.

3. A machine in accordance with claim 1, characterized by the drive rollers having equal diameters and each set is attached so that they are axially adjustable on a drive shaft in that the counter-rollers have the same diameter and width as well as the same path characteristics as drive rollers, said drive rollers and counter-rollers are produced with an elastic coating.

4. A machine in accordance with claim 3, characterized by the drive rollers being linked to an adjustable pressing device for setting the rolling pressure.

5. A machine in accordance with claim 3, characterized by the counter-rollers being located individually in housing supports which can be locked at any selected lateral position on a transverse beam.

6. A machine in accordance with claim 2, characterized by the edge forming units being supported by a laterally adjustable support which rest against one of the forming rollers, the counter-rolling unit is one or more forming rollers, the rollers for edge forming consists of an outer cylindrical surface and a conical surface which is supported free-running by an axle pin.

7. A machine in accordance with claim 1, characterized by the upward forming rollers being adjustable in height by an adjustment means so that they can be adjusted as a unit.

8. A machine in accordance with claim 1, characterized by the forming rollers being located so that they are axially adjustable on a common shaft for each profiling step.

9. A machine in accordance with claim 1, characterized in that the drive rollers in the drive unit for feeding sheet material into the machine have a smaller diameter than the subsequent drive rollers in the machine.

10. A machine in accordance with claim 1, characterized in that the drive unit includes means for operating the drive rollers for feeding sheet material into the machine at a lower rotational velocity than the subsequent drive rollers in the machine.

* * * * *